US007004141B2

(12) United States Patent
Matthews et al.

(10) Patent No.: US 7,004,141 B2
(45) Date of Patent: Feb. 28, 2006

(54) METHOD AND APPARATUS FOR OBTAINING A CONSISTENT PEDAL POSITION FOR A VEHICLE HAVING AN ENGINE WITH DISPLACEMENT ON DEMAND

(75) Inventors: Gregory Paul Matthews, West Bloomfield, MI (US); Charles Henry Folkerts, Troy, MI (US)

(73) Assignee: General Motors Corporation, Detroit, MI (US)

( * ) Notice: Subject to any disclaimer, the term of this patent is extended or adjusted under 35 U.S.C. 154(b) by 611 days.

(21) Appl. No.: 09/845,120

(22) Filed: Apr. 30, 2001

(65) Prior Publication Data

US 2002/0157640 A1 Oct. 31, 2002

(51) Int. Cl.
*F02B 17/00* (2006.01)

(52) U.S. Cl. ..... 123/295; 123/198 F

(58) Field of Classification Search ..... 123/399, 123/350, 481, 198 F
See application file for complete search history.

(56) References Cited

U.S. PATENT DOCUMENTS

| | | | | |
|---|---|---|---|---|
| 4,401,069 | A * | 8/1983 | Foley | 123/198 F |
| 5,267,541 | A * | 12/1993 | Taguchi et al. | 123/198 F |
| 5,398,544 | A * | 3/1995 | Lipinski et al. | 73/118.2 |
| 5,529,296 | A * | 6/1996 | Kato et al. | 267/155 |
| 5,540,633 | A * | 7/1996 | Yamanaka et al. | 477/107 |
| 5,727,425 | A * | 3/1998 | Lee | 74/500.5 |
| 5,970,943 | A * | 10/1999 | Robichaux et al. | 123/198 F |
| 6,360,713 | B1 * | 3/2002 | Kolmanovsky et al. | 123/295 |
| 6,553,958 | B1 * | 4/2003 | Kolmanovsky et al. | 123/295 |
| 6,561,145 | B1 * | 5/2003 | Stockhausen et al. | 123/90.15 |

* cited by examiner

*Primary Examiner*—Carl S. Miller
(74) *Attorney, Agent, or Firm*—Christopher DeVries

(57) ABSTRACT

An engine control system in a vehicle including a variable displacement internal combustion engine, an intake manifold coupled to the internal combustion engine, a throttle coupled to the intake manifold, a controller for controlling the throttle and the engine, an accelerator pedal having an accelerator pedal accelerator sensor electronically coupled to the controller, and where the controller controls the position of the throttle to maintain a substantially consistent pedal position to generate substantially the same torque for different displacements of the engine, where changes in the displacement of the engine are transparent to the operation or operator of the accelerator pedal.

14 Claims, 2 Drawing Sheets

METHOD AND APPARATUS FOR OBTAINING A CONSISTENT PEDAL POSITION FOR A VEHICLE HAVING AN ENGINE WITH DISPLACEMENT ON DEMAND

TECHNICAL FIELD

The present invention relates to the control of internal combustion engines. More specifically, the present invention relates to a method and apparatus to provide a consistent relationship between the position of an accelerator pedal and the output torque of a variable displacement internal combustion engine.

BACKGROUND OF THE INVENTION

Present regulatory conditions in the automotive market have led to an increasing demand to improve fuel economy and reduce emissions in present vehicles. These regulatory conditions must be balanced with the demands of a consumer for high performance and quick response in a vehicle. Variable displacement internal combustion engines (ICEs) provide for improved fuel economy and torque on demand by operating on the principal of cylinder deactivation. During operating conditions that require high output torque, every cylinder of a variable displacement ICE is supplied with fuel and air (also spark, in the case of a gasoline ICE) to provide torque for the ICE. During operating conditions at low speed, low load, and/or other inefficient conditions for a fully displaced ICE, cylinders may be deactivated to improve fuel economy for the variable displacement ICE and vehicle. For example, in the operation of a vehicle equipped with an eight-cylinder variable displacement ICE, fuel economy will be improved if the ICE is operated with only four cylinders during low torque operating conditions by reducing throttling losses. Throttling losses, also known as pumping losses, are the extra work that an ICE must perform to pull air around the restriction of a relatively closed throttle plate and pump air from the relatively low pressure of an intake manifold through the ICE and out to the atmosphere. The cylinders that are deactivated will not allow air flow through their intake and exhaust valves, reducing pumping losses by forcing the ICE to operate at a higher intake manifold pressure. Since the deactivated cylinders do not allow air to flow, additional losses are avoided by operating the deactivated cylinders as "air springs" due to the compression and decompression of the air in each deactivated cylinder.

In past variable displacement ICEs, when partially displaced, the operator would have to alter the position of an accelerator pedal to produce the same torque as when the ICE is fully displaced. Previous variable displacement ICEs were equipped with conventional pedal-throttle-wire couplings that required different accelerator pedal positions for the operation of a fully-displaced ICE and a partially-displaced ICE. The physical coupling between the accelerator pedal and throttle, and the inability to control throttle position as a function of displacement in previous variable displacement ICEs, prevented compensation in the accelerator pedal position for changes in output torque. The amount of air flow through the throttle required to generate the same torque for a fully-displaced and partially-displaced operation was different, requiring the physical position of the throttle plate and accelerator pedal to be different in the various operating configurations for a variable displacement ICE. Accordingly, the amount of movement in the accelerator pedal required to change the amount of torque for a fully-displaced and partially-displaced engine was also different. These differences in accelerator pedal operation, to generate the same torque for different modes of operation for a previous variable displacement engine, were nuisances to the operator of the vehicle.

The introduction of new engine control devices such as electronic throttle control (ETC), engine controllers, position sensors for pedal controls, and other electronics has enabled tighter control over more functions of an ICE. It is an object of the present invention to provide a variable displacement ICE whose operation is transparent to the operator of a vehicle.

SUMMARY OF THE INVENTION

The present invention is a method and apparatus that produces a consistent relationship between engine torque and accelerator pedal position for a vehicle equipped with a variable displacement internal combustion engine (ICE). In the preferred embodiment of the present invention, an eight-cylinder internal combustion engine (ICE) may be operated as a four-cylinder engine by deactivating four cylinders. The cylinder deactivation occurs as a function of load or torque demand by the vehicle. An engine or powertrain controller will determine if the ICE should enter four-cylinder mode by monitoring the load and torque demands of the ICE. If the ICE is in a condition where it is inefficient to operate with the full complement of eight cylinders, the controller will deactivate the mechanisms operating the valves for the selected cylinders and also shut off fuel (and possibly spark in the case of a gasoline engine) to the cylinders. The deactivated cylinders will thus function as air springs to reduce throttling and pumping losses.

As previously described, the transition between eight cylinders to four cylinders or four cylinders to eight cylinders will create changes in the air flow through the throttle plate into the ICE that also affect the torque output of the ICE and consequently the accelerator pedal position needed to generate a specific torque. The method and apparatus of the present invention uses electronic throttle control (ETC) to maintain the same engine torque and accelerator pedal position during and after a cylinder deactivation and reactivation process for the variable displacement ICE. The implementation and integration of the control schemes of the present invention will allow for a seamless transition from all cylinders firing (reactivation) to half the cylinders firing (deactivation) without disturbing the operation of the accelerator pedal.

DESCRIPTION OF THE PREFERRED EMBODIMENT

Figure 1:
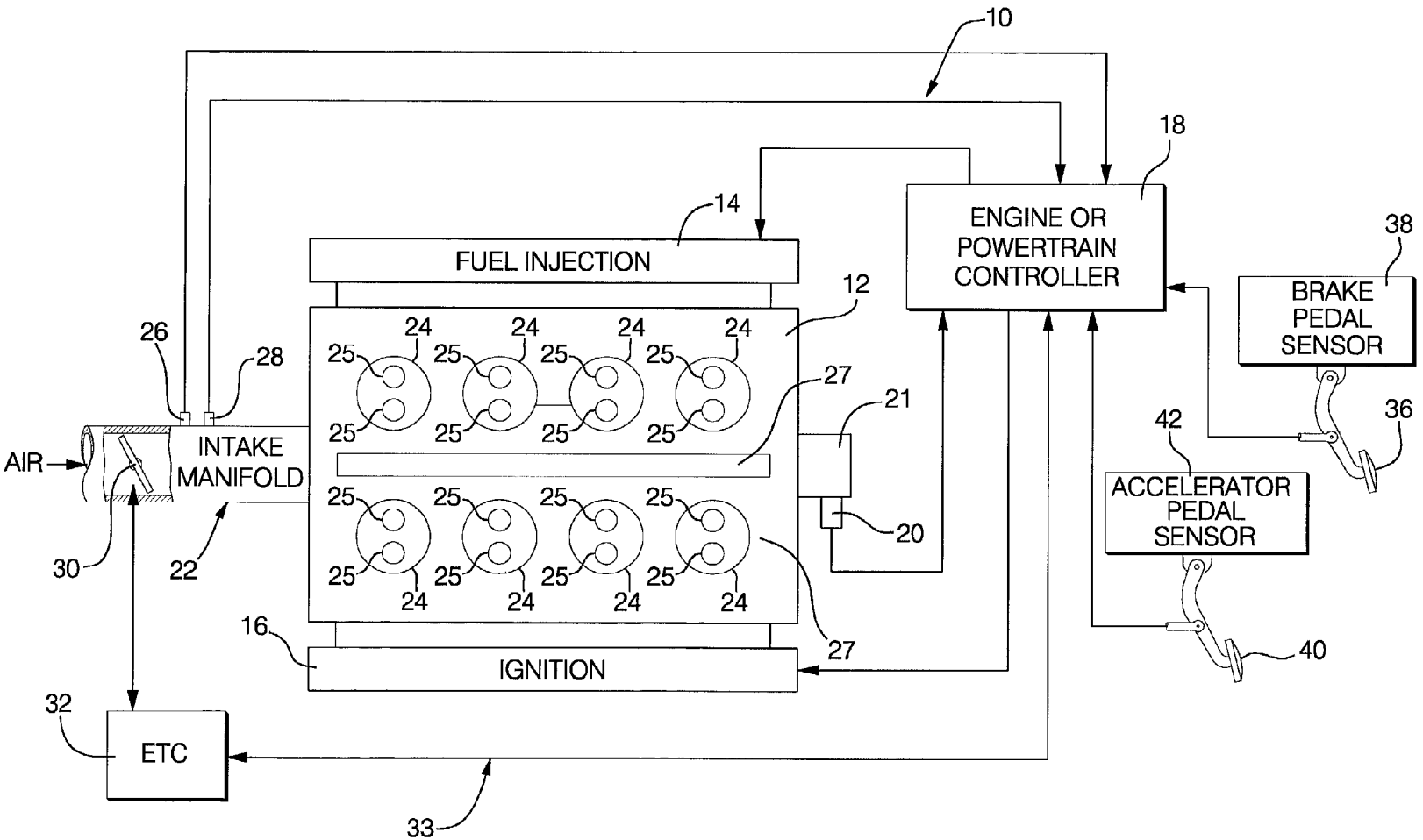
FIG. 1 is a diagrammatic drawing of the control system of the present invention.

FIG. 1 is a diagrammatic drawing of the vehicle control system 10 of the present invention. The control system 10 includes a variable displacement ICE 12 having fuel injectors 14 and spark plugs 16 controlled by an engine or powertrain controller 18. The ICE 12 crankshaft 21 speed and position are detected by a speed and position detector 20 that generates a signal such as a pulse train to the engine controller 18. The ICE 12 may comprise a gasoline ICE, or any other ICE known in the art. An intake manifold 22 provides air to the cylinders 24 of the ICE 10, the cylinders having valves 25. The valves 25 are further coupled to an actuation apparatus such as a camshaft 27 used in an overhead valve or overhead cam configuration that may be physically coupled and decoupled to the valves 25 to shut off air flow through the cylinders 24. An air flow sensor 26 and manifold air pressure (MAP) sensor 28 detect the air flow and air pressure within the intake manifold 22 and generate signals to the powertrain controller 18. The airflow sensor 26 is preferably a hot wire anemometer, and the MAP sensor 28 is preferably a strain gauge.

An electronic throttle 30 having a throttle plate controlled by an electronic throttle controller 32 controls the amount of air entering the intake manifold 22. The electronic throttle 30 may utilize any known electric motor or actuation technology in the art including, but not limited to, DC motors, AC motors, permanent magnet brushless motors, and reluctance motors. The electronic throttle controller 32 includes power circuitry to modulate the electronic throttle 30 and circuitry to receive position and speed input from the electronic throttle 30. In the preferred embodiment of the present invention, an absolute rotary encoder is coupled to the electronic throttle 30 to provide speed and position information to the electronic throttle controller 32. In alternate embodiments of the present invention, a potentiometer may be used to provide speed and position information for the electronic throttle 30. The electronic throttle controller 32 further includes communication circuitry such as a serial link or automotive communication network interface to communicate with the powertrain controller 18 over an automotive communications network 33. In alternate embodiments of the present invention, the electronic throttle controller 32 may be fully integrated into the powertrain controller 18 to eliminate the need for a physically separate electronic throttle controller.

A brake pedal 36 in the vehicle is equipped with a brake pedal sensor 38 to determine the amount of pressure generated by an operator of the vehicle on the brake pedal 36. The brake pedal sensor 36 generates a signal to the powertrain controller 18 to determine a braking condition for the vehicle. A braking condition will indicate a low torque/low demand condition for the variable displacement ICE 12. An accelerator pedal 40 in the vehicle is equipped with a pedal position sensor 42 to sense the position of the accelerator pedal. The pedal position sensor 42 signal is also communicated to the powertrain controller 18. In the preferred embodiment of the present invention, the brake pedal sensor 38 is a strain gauge and the pedal position sensor 42 is an absolute rotary encoder.

Figure 2:
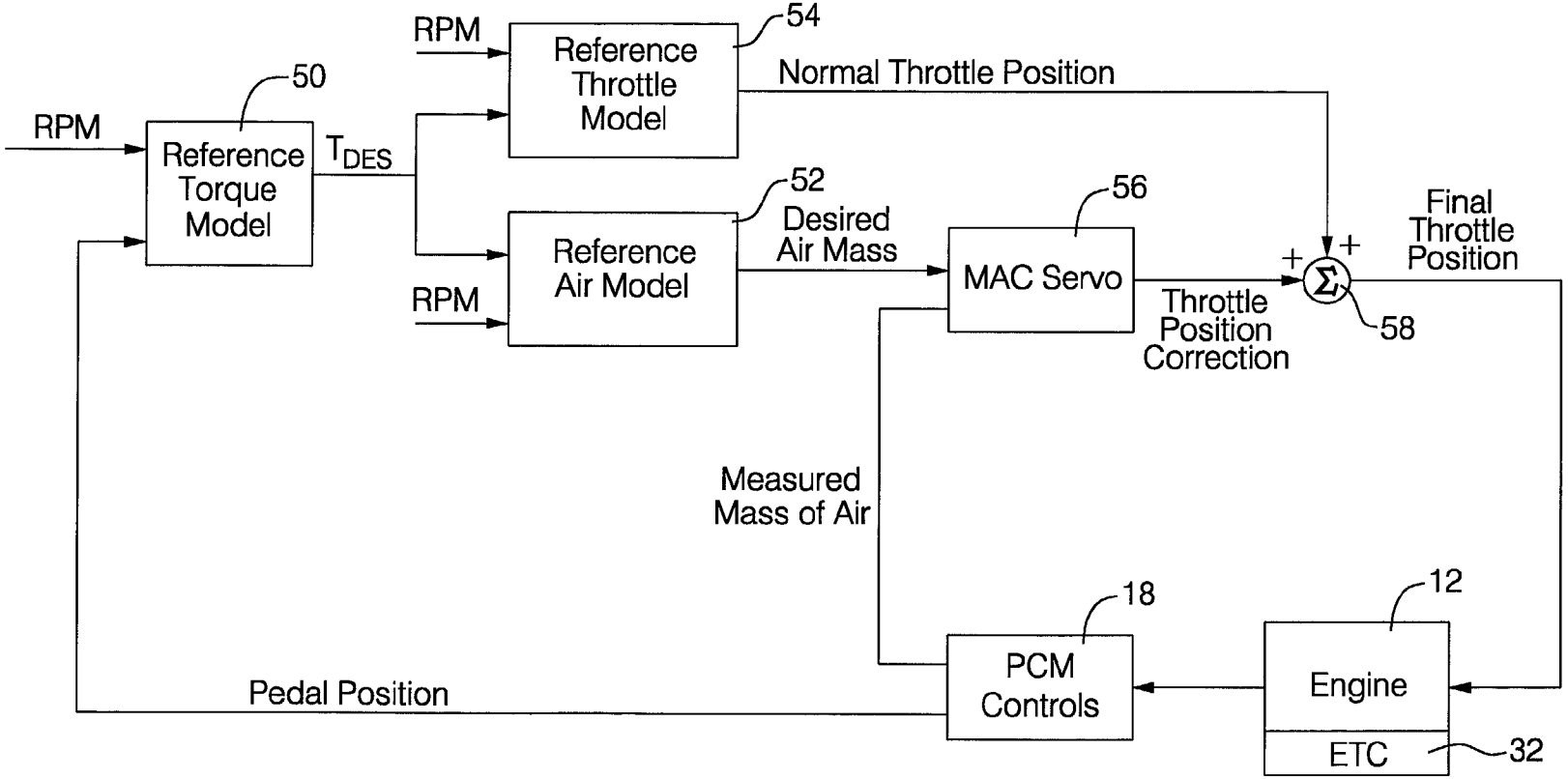
FIG. 2 is a process control diagram for the control system of the present invention.

FIG. 2 is a process control diagram for the control system 10 of the present invention. The control system 10 of the present invention is based on controlling the electronic throttle 30 to provide a consistent position or feel for the accelerator pedal 40 to generate the same torque in the ICE 12 when it is partially displaced or fully displaced. The powertrain controller 18 and electronic throttle controller 32 of the present invention include software to execute the methods of the present invention.

Referring to FIG. 2, at block 50 of the process diagram, a reference torque model based on the ICE 12 displacement is used to develop a torque map or lookup table which determines the amount of torque that the driver is requesting ($T_{DES}$) based on ICE 12 crankshaft 21 revolutions per minute (RPMs) and accelerator pedal 40 position. The powertrain controller 18 determines the accelerator pedal 40 position from the signal generated by the pedal position sensor 42. The powertrain controller 18 further determines the rotations/minute (RPMs) of the ICE 12 crankshaft 21 from the pulse train generated from the crankshaft speed sensor 20.

At block 52, the powertrain controller 18 computes a desired mass air flow or the mass-air/cylinder (MAC) needed to produce the desired torque in the ICE 12 with only half (preferably four for an eight-cylinder ICE) and all of the of the cylinders 24 activated. The term activated for a cylinder 24 will be characterized as supplying a cylinder 24 with air, fuel, and spark or any permutation thereof. The desired air mass or MAC determined at block 52 is preferably determined by using the $T_{DES}$ and the ICE 12 crankshaft RPM in conjunction with a lookup table stored in the powertrain controller 18 memory. At block 54, the powertrain controller 18 computes the nominal electronic throttle 30 position (or area) needed to produce the $T_{DES}$ based in the ICE 12 with only half (preferably four for an eight-cylinder ICE) and all of the cylinders 24 activated. Generally, when running on half of the cylinders 24, it will require a larger throttle opening for the ICE 12 to generate a given torque. The nominal electronic throttle 30 position is preferably determined by using the $T_{DES}$ and the crankshaft 21 RPM feedback in conjunction with a lookup table stored in the powertrain controller 18 memory.

At block 56, the powertrain controller 18 operates a MAC servo control scheme operating in closed loop mode to insure that the requested MAC is achieved. The MAC servo control corrects or trims the nominal throttle position based on the actual measured air mass determined by the powertrain controller 18. The measured mass air flow comprises the process variable for the MAC servo method, the setpoint is the desired mass air flow, and the MAC servo method output is the throttle position correction. The MAC servo method may comprise a control algorithm based on fuzzy logic, proportional-integral-derivative methods, and/or neural networks. The measured mass air per cylinder may utilize the actual readings of the air flow sensor 26 or a processed/conditioned mass air flow reading based on the processing of the MAP sensor 28, the air flow sensor 26 and/or the throttle position sensor. Under nominal conditions, torque is proportional to the mass of air inducted into the ICE 12. Accordingly, the MAC servo method ultimately determines a throttle position correction necessary to achieve the $T_{DES}$. The throttle position correction component compensates for vehicle-vehicle differences, throttle wear, and other variations in the throttle flow characteristics.

A summer 58 adds the throttle position correction generated at block 56 to the nominal required throttle position generated at block 54. The final throttle position command is communicated from the powertrain controller 18 to the electronic throttle controller 32 to execute the final throttle position command for the ICE 12.

While this invention has been described in terms of some specific embodiments, it will be appreciated that other forms can readily be adapted by one skilled in the art. Accordingly, the scope of this invention is to be considered limited only by the following claims.

What is claimed is:

1. An engine control system in a vehicle comprising:

a variable displacement internal combustion engine;

actuators operatively coupled to valves of said variable displacement internal combustion engine;

an intake manifold coupled to said variable displacement internal combustion engine;

a throttle coupled to said intake manifold;

a controller for controlling said throttle and said variable displacement internal combustion engine;

an accelerator pedal having an accelerator pedal position sensor electronically coupled to said controller;

wherein said actuators close at least one set of valves to a cylinder when said cylinder is deactivated to substantially prevent air flow through said cylinder; and wherein said controller controls the position of said throttle based upon at least a reference torque model to maintain a substantially consistent accelerator pedal position to generate substantially the same torque for different displacements of the variable displacement internal combustion engine, whereby changes in the displacement of the variable displacement internal combustion engine are transparent to the operation of said accelerator pedal.

2. The engine control system of claim 1 wherein said throttle is an electronic throttle.

3. The engine control system of claim 1 wherein said accelerator pedal position sensor is an encoder.

4. The engine control system of claim 1 wherein said variable displacement internal combustion engine is a gasoline engine.

5. The engine control system of claim 1 wherein said variable displacement internal combustion engine includes at least two cylinders.

6. The engine control system of claim 1 wherein said variable displacement internal combustion engine is an eight-cylinder engine.

7. The engine control system of claim 1 further including an airflow sensor to detect airflow through said intake manifold.

8. A method of varying throttle position in a variable displacement internal combustion engine to produce a consistent relationship between the generated torque of the variable displacement internal combustion engine and the position of an accelerator pedal, comprising:

providing an electronic control module;

providing an electronic throttle;

providing an accelerator pedal having a position sensor;

varying the displacement of the engine;

substantially preventing air flow through a cylinder of the engine in a partially displaced operating mode;

converting the position of the accelerator pedal to a throttle position command using a reference torque model; and adjusting said electronic throttle in response to said throttle position command and the displacement of the variable displacement internal combustion engine to maintain substantially the same torque for different displacements of the variable displacement internal combustion engine and an accelerator pedal position, whereby the position of said accelerator pedal will remain consistent for substantially the same variable displacement internal combustion engine output torque for different displacements of the variable displacement internal combustion engine.

9. The method of claim 8 further comprising the steps of:

providing an air flow sensor for measuring air flow into the variable displacement internal combustion engine; and adjusting the electronic throttle in response to the airflow.

10. The method of claim 9 further comprising the step of providing a manifold air pressure sensor for determining the air flow into the variable displacement internal combustion engine.

11. The method of claim 8 further comprising the step of providing a throttle position connection using a mass-air/cylinder servo control loop.

12. A method of providing a consistent feel in an accelerator pedal for a variable displacement internal combustion engine comprising the steps of:

providing an electronic throttle;

providing a position sensor for the accelerator pedal;

providing a reference torque model for the variable displacement internal combustion engine;

providing a reference air flow model for the variable displacement internal combustion engine;

providing a reference throttle model for the electronic throttle;

substantially preventing air flow through a cylinder of the variable internal combustion engine in a partially displaced operating mode;

generating a desired torque using said reference torque model;

generating a desired air flow using said reference air model; and adjusting said electronic throttle based on said desired torque, said desired air flow, and said reference throttle model to provide a consistent accelerator pedal position to produce a corresponding torque that is independent of the number of cylinders running in the variable displacement internal combustion engine.

13. The method of claim 12 further comprising the step of varying the displacement of the variable displacement internal combustion engine.

14. The method of claim 12 further comprising the step of providing a mass-air/cylinder servo to adjust said electronic throttle.

* * * * *